US007800555B2

(12) United States Patent
Sasaki et al.

(10) Patent No.: US 7,800,555 B2
(45) Date of Patent: Sep. 21, 2010

(54) METHOD OF DRIVING PLASMA DISPLAY PANEL

(75) Inventors: Kenji Sasaki, Osaka (JP); Kenji Ogawa, Osaka (JP)

(73) Assignee: Panasonic Corporation, Osaka (JP)

( * ) Notice: Subject to any disclaimer, the term of this patent is extended or adjusted under 35 U.S.C. 154(b) by 577 days.

(21) Appl. No.: 11/722,621

(22) PCT Filed: Mar. 23, 2006

(86) PCT No.: PCT/JP2006/305781

§ 371 (c)(1),
(2), (4) Date: Jun. 22, 2007

(87) PCT Pub. No.: WO2006/109478

PCT Pub. Date: Oct. 19, 2006

(65) Prior Publication Data

US 2010/0033506 A1 Feb. 11, 2010

(30) Foreign Application Priority Data

Mar. 31, 2005 (JP) ..... 2005-102213

(51) Int. Cl.
*G09G 3/28* (2006.01)

(52) U.S. Cl. ..... 345/60; 345/62; 345/63; 315/169.3

(58) Field of Classification Search ..... 345/37, 345/41, 89, 60, 62, 690; 315/169.1, 169.2, 315/169.3

See application file for complete search history.

(56) References Cited

U.S. PATENT DOCUMENTS

2005/0127846 A1* 6/2005 Kim ..... 315/169.4

FOREIGN PATENT DOCUMENTS

| | | |
|---|---|---|
| JP | 08-320668 | 12/1996 |
| JP | 10-319900 | 12/1998 |
| JP | 2000-242224 | 9/2000 |
| JP | 2000-259119 | 9/2000 |
| JP | 2001-242823 | 9/2001 |
| KR | 10-2004-0021397 | 3/2004 |

OTHER PUBLICATIONS

International Search Report for application No. PCT/JP2006/305781 dated Jun. 27, 2006.

* cited by examiner

*Primary Examiner*—Amare Mengistu
*Assistant Examiner*—Premal Patel
(74) *Attorney, Agent, or Firm*—RatnerPrestia

(57) ABSTRACT

A driving method of plasma display panels is disclosed. This method can suppress a dark belt occurring in displaying a video of a lower part of grayscale. One field includes plural sub-fields, and each one of the sub-fields has an addressing period during which a scan pulse is applied to the scan electrodes and a data pulse is applied to the data electrodes, and a sustaining period during which a sustain pulse is applied to the scan electrodes and the sustain electrodes. A time interval between a scan pulse applied lastly during the addressing period and a sustain pulse applied firstly during the sustaining period is defined as a last pulse-interval. The last pulse-interval of at least one sub-field of a lower part of grayscale, which lower part is darker than a predetermined level of the grayscale, is set longer than the last pulse-intervals of the other sub-fields.

4 Claims, 8 Drawing Sheets

Voltage (V)
Time (t)
Data Electrode D1~Dm
Scan electrode SCN1
Scan electrode SCN2
Scan electrode SCNn
Sustain electrode SUS1~SUSn
0
Vr
Vg
Vp
Va
Vm
Vb
Vh
PS1
PS2
PS3
P1
P2
Pn
TP1
TP2
TP3
TP10
Initializing period
Addressing period
Sustaining period
First SF
Second SF
Third SF
10th SF
One field period

FIG. 6

| | Number of sustain pulses (pieces) | | | | | | |
|---|---|---|---|---|---|---|---|
| | 1 | 5 | 10 | 20 | 30 | 40 | 50 |
| Embodiment | A | A | A | A | A | A | A |
| Comparison | C | C | B | B | B | A | A |

METHOD OF DRIVING PLASMA DISPLAY PANEL

THIS APPLICATION IS A U.S. NATIONAL PHASE APPLICATION OF PCT INTERNATIONAL APPLICATION PCT/JP2006/305781.

TECHNICAL FIELD

The present invention relates to a method of driving a plasma display panel to be used in a slim and lightweight display device having a large screen.

BACKGROUND ART

A surface discharge AC plasma display panel (hereinafter referred to simply as a "panel") is one of typical plasma display panels, and the surface discharge AC panel includes numbers of discharge cells formed between a front substrate and a rear substrate which confronts the front substrate. Both of the substrates are made of glass. On the front substrate, a plurality of display electrodes, each one of which is formed of a pair of a scan electrode and a sustain electrode, are formed in parallel with each other, and a dielectric layer and a protective layer are formed such that they cover the display electrodes. On the rear substrate, a plurality of data electrodes are formed in parallel with each other, and a dielectric layer is formed to cover the data electrodes, on top of that, a plurality of barrier ribs are formed in parallel with the data electrodes. A phosphor layer is formed on the surface of the dielectric layer and on the lateral faces of the barrier ribs.

The front and rear substrates confront each other and are sealed such that the display electrodes intersect with the data electrodes, and the space between the front and rear substrates sealed is filled with a dischargeable gas. This structure allows forming discharge cells at each confronting section between the display electrodes and the data electrodes. In every discharge cell, ultraviolet ray is generated by gas discharge, and the ultraviolet ray excites the phosphors to emit red, green, and blue colors, so that a color display is achieved.

A sub-field method is widely used for driving the panel. According to this method, one field period is divided into a plurality of sub-fields, then a combination of the sub-fields, which are supposed to emit light, allows displaying a grayscale. Each one of the sub-fields has a given brightness weight, and lighting the sub-fields results in a given brightness display in response to the brightness weights. Among the sub-field methods, light emitting of sub-fields not involved in the gray scale display is reduced as much as possible for suppressing the black brightness, thereby increasing a contrast ratio. This driving method is disclosed in, e.g. Unexamined Japanese Patent Publication No. 2000-242224.

Hereinafter, the foregoing driving method is detailed. FIG. 8 shows driving waveforms illustrating a conventional driving method of a panel. Each one of sub-fields has an initializing period, an addressing period, and a sustaining period. During the initializing period, the cells involved are entirely initialized or selectively initialized. To be more specific, the discharge cells involved in displaying a video are entirely initialized for discharging, or only the discharge cells that carried out the sustain discharge at the immediate last sub-field are selected and initialized for discharging. In the driving waveforms shown in FIG. 8, the entire initialization is done during the initializing period of the first sub-field (hereinafter sometimes referred to simply as "SF"), and the selective initialization is done during the initializing periods of the second SF and onward.

First, during the initializing period of the first SF, all the discharge cells are initialized for discharging in order to erase the historical record of wall charges of the respective discharge cells as well as form wall charges necessary for the coming address operation. On top of that, this initialization also generates priming, i.e. generates excited particles which can minimize a discharge delay as well as generate an address discharge in a stable manner. This entire initialization is done this way: Keep all the data electrodes and the sustain electrodes at 0 (zero) volt (grounding potential), then apply a lamp voltage to all the scan electrodes. The lamp voltage moderately increases from voltage Vp lower than the discharge starting voltage to voltage Vr over the discharge starting voltage.

The foregoing preparation allows all the discharge cells to discharge faintly, and the sustain electrodes as well as the data electrodes to store positive wall charges thereon, and the scan electrodes to store negative wall charges thereon. Then keep all the sustain electrodes at voltage Vh, and apply a lamp voltage to all the scan electrodes. This lamp voltage moderately decreases from voltage Vg to voltage Va, so that all the discharge cells faintly discharge for weakening the wall charges stored on the respective electrodes. The entire initialization discussed above allows the voltage in the discharge cells to become close to the discharge starting voltage.

During the addressing period of the first SF, apply scan pulses sequentially to the scan electrodes for scanning the scan electrodes, and apply address pulses, corresponding to the video signals to be displayed, to the data electrodes, thereby generating address discharge between the scan electrodes and the data electrodes in the discharge cells to be displayed, namely, display cells, for forming wall charges selectively. During the sustaining period following the addressing period, apply sustain pulses a given times in response to the brightness weight between the scan electrodes and the sustain electrodes, thereby generating sustain discharge in the discharge cells, in which wall charges have been formed with the address discharge, for emitting light. This light emission allows displaying a video.

During the initializing period of the second SF, keep all the sustain electrodes at voltage Vh, and all the data electrodes at 0 (zero) volt. Then apply a lamp voltage to all the scan electrodes. This lamp voltage moderately lowers from voltage Vb to voltage Va. While the lamp voltage lowers, the discharge cells, which have carried out sustain discharge during the immediate last sustaining period, i.e. the sustaining period of the first SF, faintly discharge for adjusting the wall charges formed on the respective electrodes. The voltage in the discharge cells thus becomes close to the discharge starting voltage. On the other hand, the discharge cells, which have not carried out the address discharge and the sustain discharge during the first SF, do not discharge even faintly during the initializing period of the second SF, so that the wall charges are kept as they are at the time when the initializing period of the first SF ends.

During the addressing period and the sustaining period of the second SF, apply a driving waveform similar to that of the first SF to the respective electrodes, thereby generating sustain discharge in the discharge cells corresponding to video signals. During the third SF and onward to the final SF, apply a driving waveform similar to that of the second SF to the respective electrodes, thereby displaying a video. The brightness weights in the respective sub-fields are set, for instance, to increase step by step from the first SF to the final SF.

In the case of displaying uniformly a video of lower part of grayscale on the entire screen by using the conventional driving method discussed above, the following method is taken as an instance: When the sustain discharge is carried out only in the first SF where the lowest part of grayscale takes place, a dark area sometimes occurs in a part of the screen, and the dark area is a belt-like shape and has a lower brightness than other areas. In general, the panel is placed for displaying videos such that the scan electrodes and the sustain electrodes arranged horizontally, and the data electrodes are arranged vertically. In the case of using the panel driven by a single scanning method, a horizontal dark belt can be seen sometimes at the lower part of the screen. In the case of using the panel driven by a double scanning method, the horizontal dark belts sometimes can be seen at the center and at the lower part of the screen.

The panel driven by the single scanning method scans every scan electrodes sequentially from the top during the addressing period, while the panel driven by the double scanning method scans the scan electrodes in the upper half area and those in the lower half area respectively and sequentially from the top of each area with the timings nearly equal to each other. FIG. 8 shows the driving waveforms of the panel driven by the single scanning method.

Since the conventional driving method discussed above sometimes invites the foregoing dark belt, it is difficult to display uniformly the video of a lower part of gray scale on the screen. The display quality thus becomes poor. In the case of the panel driven by the double scanning method, in particularly, the dark belt occurs at the center of the screen conspicuously, so that the display quality becomes worse.

DISCLOSURE OF INVENTION

The present invention provides a method of driving plasma display panels, and the method allows displaying a quality video by suppressing the occurrence of dark belts when a video of a lower part of grayscale is displayed.

The inventors have studied the factors of generating the dark belt and obtained the following result: FIG. 9 shows driving waveforms which illustrate a conventional driving method of the panels. The waveform shown in FIG. 9 is applied to the first, second, (n−1)th, and (n)th scan electrodes out of "n" pieces of scan electrodes SCNi (i=1−n) during a part of the initializing and sustaining periods of the first SF shown in FIG. 8. FIG. 9 shows the driving waveforms in part for illustrating the conventional driving method of the panels, so that FIG. 9 omits the driving waveforms to be applied to the data electrodes and the sustain electrodes. As shown in FIG. 9, a time interval between scan pulse Pi to be applied during the addressing period and sustain pulse PS1 to be applied at the top of the sustaining period is referred to as "pulse interval".

Among those pulse intervals, the particular pulse interval between last scan pulse Pn applied at the end of the addressing period (the scan pulse applied to the "n"th scan electrode SCNn) and first sustain pulse PS1 applied at the top of the sustaining period is referred to as "the last pulse interval". The pulse interval covers the time between after the occurrence of address discharge and just before the application of the first sustain pulse. The dark belt occurs in the area of the discharge cells corresponding to the scan electrodes roughly from (n−10)th electrode to (n)th electrode, although this phenomenon depends on the types of panels. However, data tells that the dark belt occurs in the area of discharge cells having short "pulse intervals".

In the discharge cells of short pulse-intervals, priming effect due to the address discharge remains rather stronger than in the discharge cells of long pulse-intervals, so that the sustain discharge generated by first pulse PS1 applied firstly during the sustaining period tends to be generated at a lower voltage. In other words, the first sustain discharge tends to occur at a lower voltage. A discharge delay also tends to become shorter. Light emitted by the first sustain discharge thus becomes dark. However, the second and onward sustain discharges apply sustain pulses to all the discharge cells with the same timing, so that little difference occurs in light-emission intensity due to differences in pulse intervals.

The grayscale of video display is expressed with the number of light emissions of the sustain discharge. When a large number of light emissions take place such as in a display of a higher part of grayscale, if the light emission of the sustain discharge by the first sustain pulse PS1 becomes dark, this one light-emission affects the grayscale only a little, so that the human eyes cannot recognize the affected grayscale and the video quality lowers little. However, when a small number of light emissions take place such as in a display of a lower part of grayscale, if the light emission of the sustain discharge by the first sustain pulse PS1 becomes dark, this one light-emission affects the display of a lower part of grayscale more greatly, and the human eye can positively recognize the affected grayscale as the dark belt discussed above.

The present invention is achieved based on the foregoing experiment. The driving method of the present invention is used for driving the plasma display panel which comprises: a substrate on which a plurality of pairs, each one of which pairs is formed of a scan electrode and a sustain electrode, are placed; and another substrate on which a plurality of data electrodes are placed such that they intersect with both of the scan electrodes and the sustain electrodes at right angles. The substrate and the another substrate confront each other. One field period includes a plurality of sub-fields, which has an addressing period and a sustaining period. During the addressing period, scan pulses are applied to scan electrodes and data pulses are applied to data electrodes.

During the sustaining period, sustain pulses are applied to the scan electrodes and the sustain electrodes. The time interval between the last scan pulse applied at the end of the addressing period and the first sustain pulse applied at the top of the sustain period is defined as the last pulse-interval. The panel is so driven that the last pulse-interval of the sub-field having at least one lower part of grayscale, which lower part is darker than a given level of the grayscale, becomes longer than the last pulse-interval of the other sub-fields. This driving method allows suppressing an occurrence of a dark belt which appears when a video of a lower part of grayscale is displayed, thereby displaying a quality video.

The driving method of the present invention can drive a panel such that when a sub-field of a lower part of grayscale is lighted, the last pulse-interval of this sub-field to be lighted becomes longer than the last pulse-intervals of the other sub-fields. This method allows eliminating a useless driving time which is not effective to improve the display quality.

The driving method of the present invention can set the total number of sustain pulses, which are to be applied to both of the scan electrodes and the sustain electrode in the sub-filed of a lower part of grayscale, in the range from not less than 1 (one) to not greater than 30. This method allows preventing the sustaining period from becoming unnecessarily long, and suppressing the occurrences of the dark belt.

BRIEF DESCRIPTION OF THE DRAWINGS

FIG. 6 shows a relation between the number of sustain pulses and a dark belt in the case of using the driving method of the plasma display panel in accordance with the first embodiment.

DESCRIPTION OF REFERENCE MARKS

Figure 1:
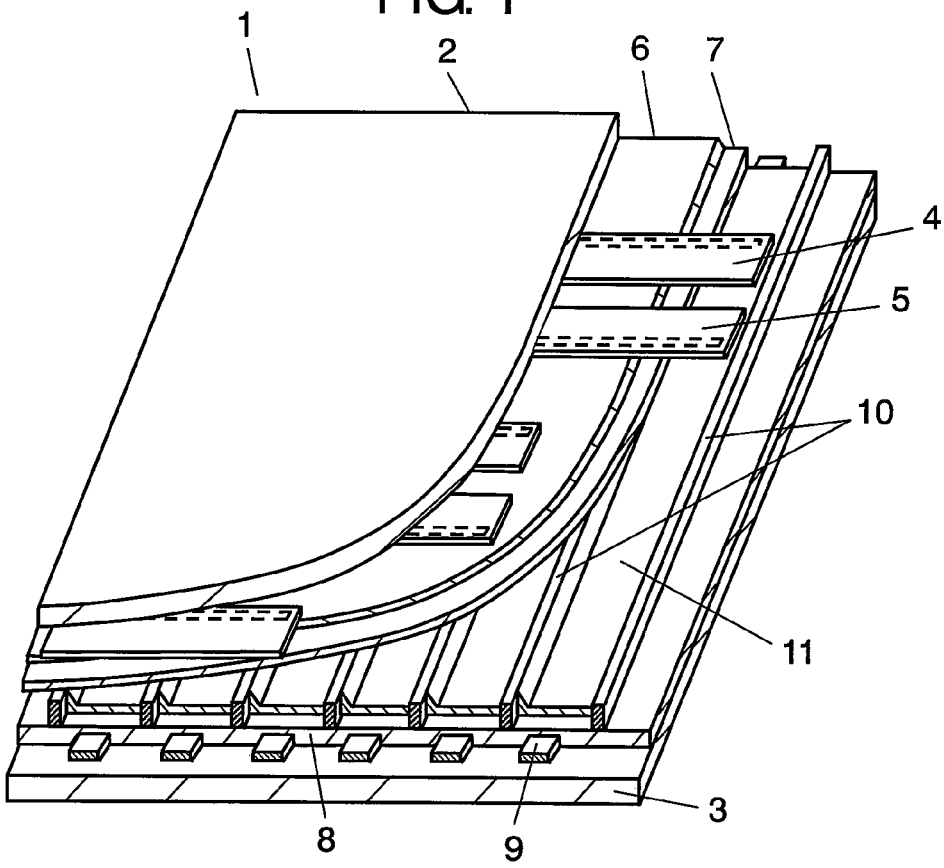
FIG. 1 shows a perspective view of a plasma display panel in part for illustrating a driving method of the plasma display panel in accordance with a first embodiment of the present invention.

1 plasma display panel
2 front substrate
3 rear substrate
4 scan electrode
5 sustain electrode
9 data electrode
12 data-electrode driving circuit
13 scan-electrode driving circuit
14 sustain-electrode driving circuit
19 last pulse-interval setting section
20 lighting SF detector

DESCRIPTION OF PREFERRED EMBODIMENTS

Exemplary embodiments of the present invention are demonstrated hereinafter with reference to the accompanying drawings.

Embodiment 1

FIG. 1 shows a perspective view of a plasma display panel in part for illustrating a method of driving the plasma display panel in accordance with the first embodiment of the present invention. Panel 1 is formed of front substrate 2 and rear substrate 3 confronting each other, and a discharge space is prepared between the two substrates made of glass. On front substrate 2, more than one pair of scan electrode 4 and sustain electrode 5 are placed in parallel with each other. This pair forms a display electrode. Dielectric layer 6 covers scan electrodes 4 and sustain electrodes 5. Protective layer 7 is formed on dielectric layer 6.

Protective layer 7 employs thin film of magnesium oxide (MgO) because MgO has a great secondary emission coefficient and is highly resistive to spattering, for these two properties are needed to generate the discharge in a stable manner. On rear substrate 3, a plurality of data electrodes covered with insulating layer 8 are placed. Barrier ribs 10 are provided on insulating layer 8, which is formed between respective data electrodes 9, in parallel with data electrodes 9. On the surface of insulating layer 8 and lateral faces of barrier ribs 10, phosphor 11 are provided. Front substrate 2 confronts rear substrate 3 such that both of scan electrodes 4 and sustain electrodes 5 intersect with data electrodes 9. In the discharge space prepared between front substrate 2 and rear substrate 3, dischargeable gas, e.g. mixed gas of neon and xenon, is filled.

Figure 2:
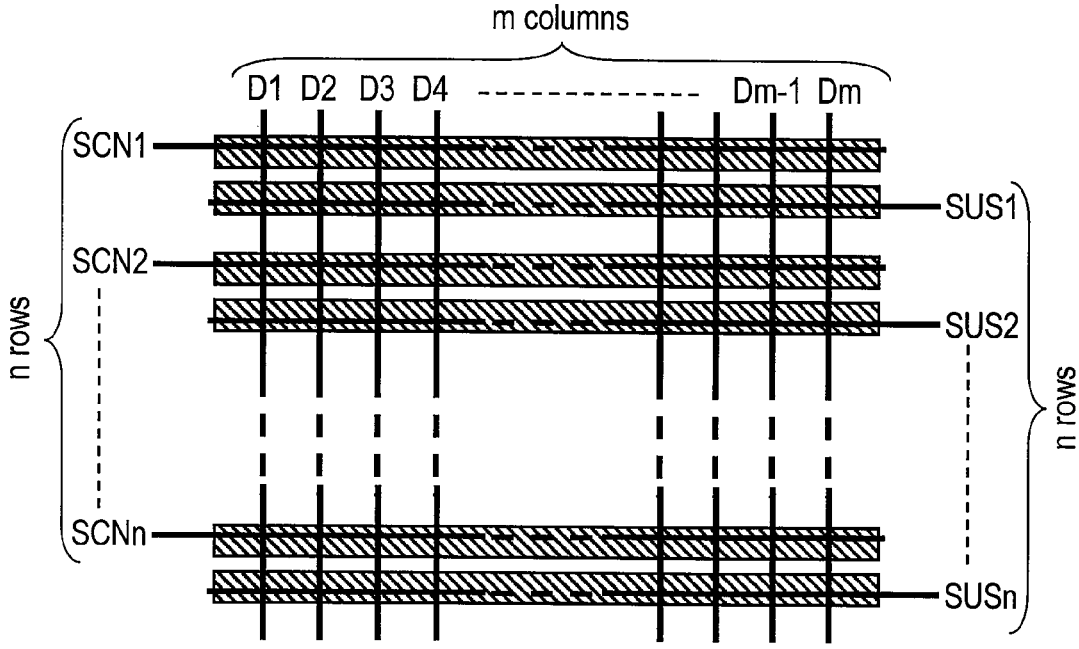
FIG. 2 shows a placement of electrodes of a plasma display panel for illustrating the driving method of the plasma display panel in accordance with the first embodiment.

FIG. 2 shows a placement of electrodes of the plasma display panel shown in FIG. 1 for illustrating a method of driving the plasma display panel in accordance with the first embodiment. Along the line direction, i.e. horizontal direction, "n" pieces of scan electrodes SCN1-SCNn (corresponding to scan electrode 4 in FIG. 1) and "n" pieces of sustain electrodes SUS1-SUSn (corresponding to sustain electrode 5 shown in FIG. 1) are placed alternately. Along the row direction, i.e. vertical direction, "m" pieces of data electrodes D1-Dm (corresponding to data electrode 9 shown in FIG. 1) are arranged. At every intersection of one data electrode Dj (j=1–m) with a pair of scan electrode SCNi and sustain electrode SUSi (i=1–n), a discharge cell is formed, namely, "m×n" pieces of discharge cells are formed in the discharge space.

Figure 3:
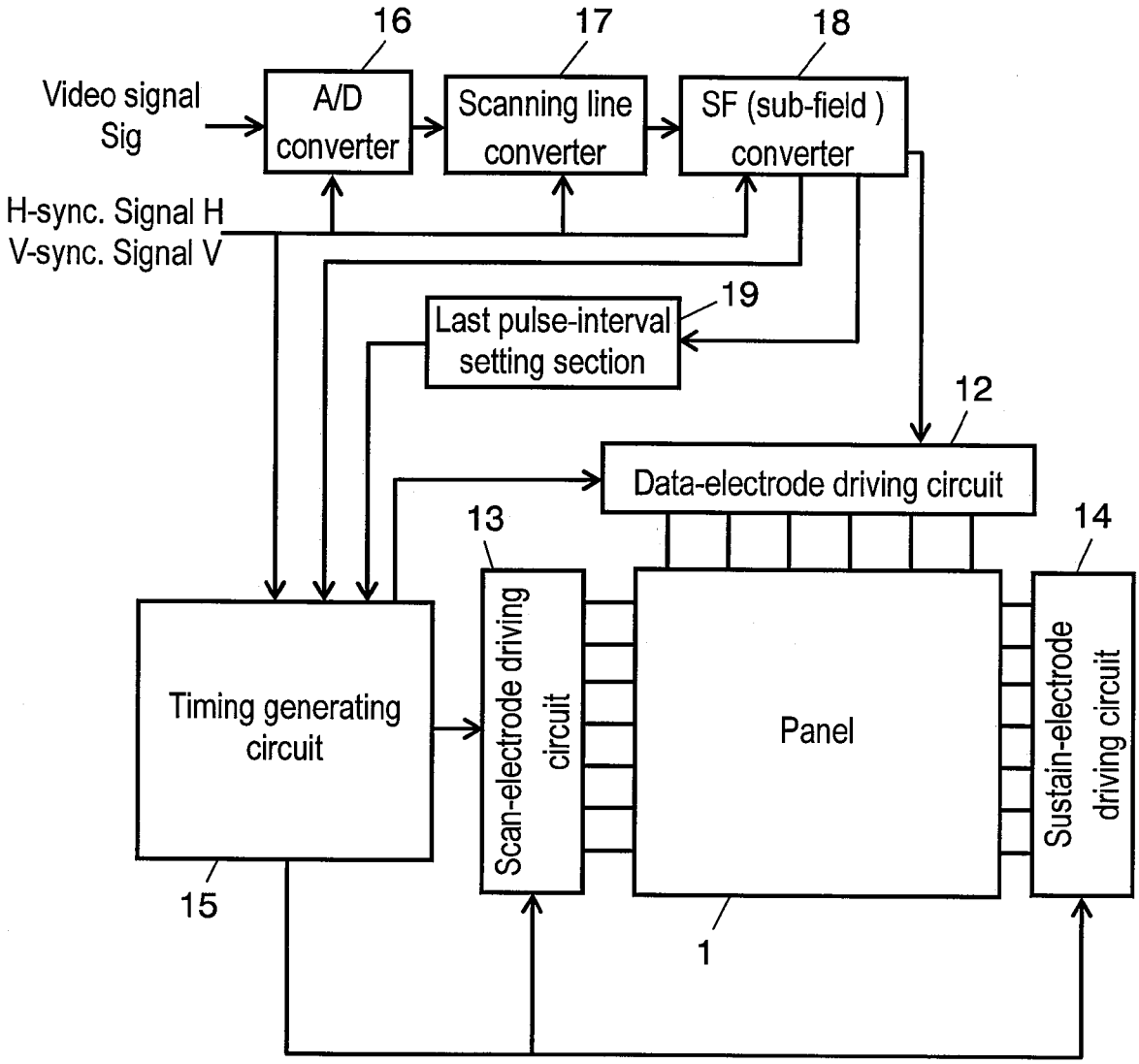
FIG. 3 shows a structure of a plasma display device for illustrating the driving method of the plasma display panel in accordance with the first embodiment.

FIG. 3 shows a structure of a plasma display device employing the panel shown in FIG. 1 and FIG. 2 for illustrating the method of driving the plasma display panel in accordance with the first embodiment. This device includes panel 1, data-electrode driving circuit 12, scan-electrode driving circuit 13, sustain-electrode driving circuit 14, timing generating circuit 15, analog/digital (A/D) converter 16, scanning line converter 17, SF converter 18, and last pulse-interval setting section 19.

In FIG. 3, video signal "sig" is fed into A/D converter 16. H-sync signal H and V-sync signal V are fed into timing generating circuit 15, A/D converter 16, scanning line converter 17, and SF converter 18. A/D converter 16 converts video signal "sig" into a digital signal, i.e. video data, and outputs the video data to scanning line converter 17, where the video data is converted into video data in response to the number of pixels of panel 1. Scanning line converter 17 outputs this video data to SF converter 18.

SF converter 18 divides the video data of every pixel into a plurality of bits corresponding to a plurality of sub-fields, and outputs the video data of every sub-field to data-electrode driving circuit 12, timing generating circuit 15, and last pulse-interval setting section 19. Last pulse-interval setting section 19 sets the last pulse-interval in response to the video data of every pixel, and outputs the resultant interval to timing generating circuit 15. Data-electrode driving circuit 12 converts the video data of every sub-field into signals corresponding to each data electrode D1-Dm, and drives data electrodes D1-Dm.

Timing generating circuit 15 generates a timing signal based on the video data of every sub-field, H-sync signal H, V-sync signal V, and the set last pulse-interval, and outputs the timing signal to scan-electrode driving circuit 13 and sustain-electrode driving circuit 14 respectively. Scan-electrode driving circuit 13 supplies a driving waveform to scan electrodes SCN1-SCNn based on the timing signal, and sustain-electrode driving circuit 14 supplies a driving waveform to sustain electrodes SUS1-SUSn based on the timing signal.

Figure 4:
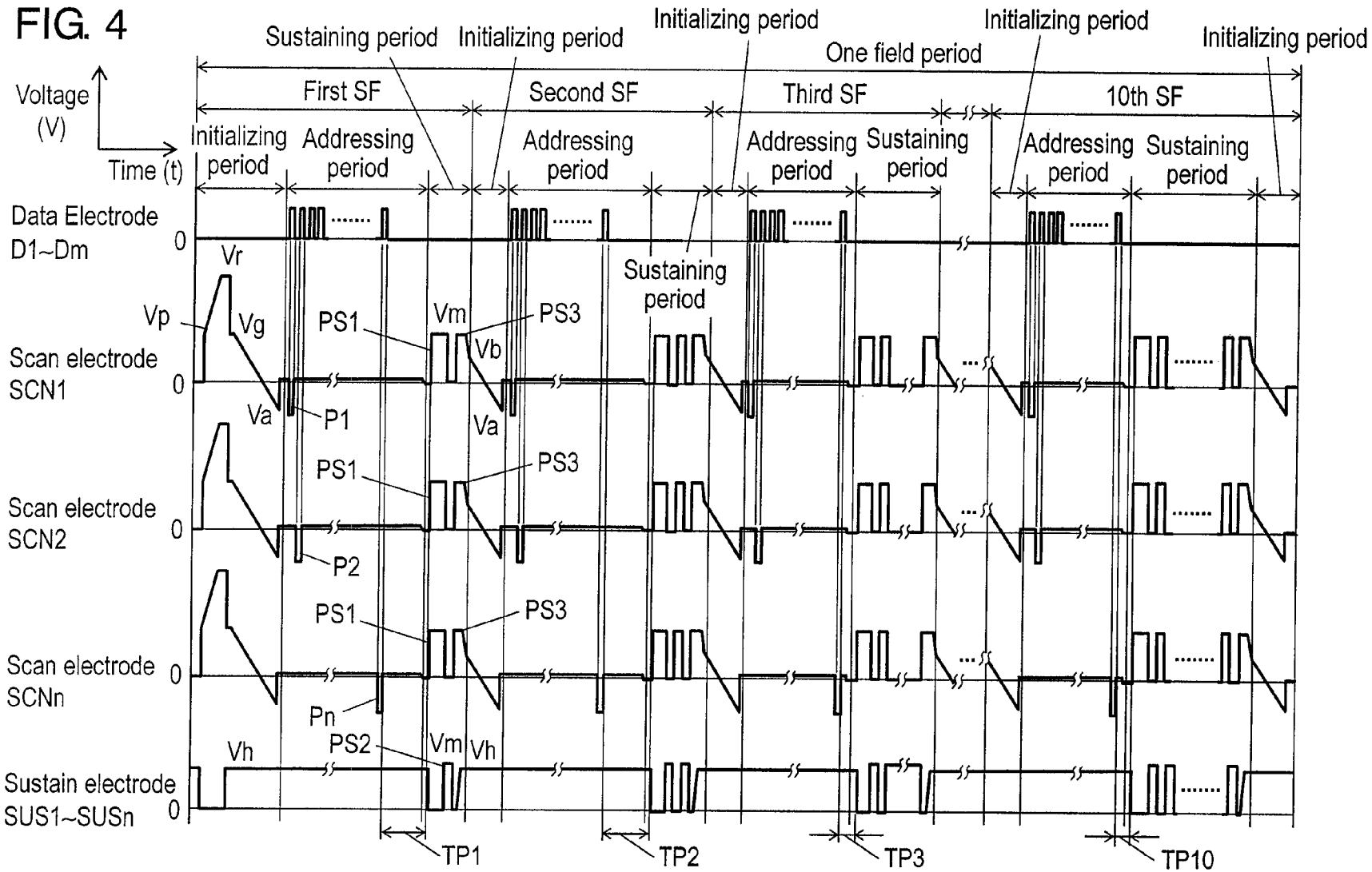
FIG. 4 shows a driving waveform for illustrating the driving method of the plasma display panel in accordance with the first embodiment.

The driving waveform for driving panel 1 and its operation are demonstrated hereinafter. FIG. 4 shows a driving waveform to be applied to the data electrodes, the scan electrodes, and the sustain electrodes for illustrating the method of driving the plasma display panel in accordance with the first embodiment. As shown in FIG. 4, one field period is divided into a plurality of sub-fields (in this embodiment: 10 sub-fields, i.e. first SF, second SF . . . , and 10th SF). Each one of the first SF-the 10th SF has brightness weight of 1, 2, 3, 6, 11, 18, 30, 44, 60, 80 respectively.)

The sub-filed placed at the latter position thus has a greater weight of brightness, although the number of sub-fields and the brightness weight are not limited to the foregoing values. Each one of the sub-fields includes an initializing period, an addressing period, and a sustaining period. During the initializing period, a charged state of a discharge cell is initialized. During the addressing period, address discharge is carried out in order to select a discharge cell to be displayed, i.e. select a display cell. During the sustaining period, sustain discharge is carried out in the discharge cells selected during the addressing period.

During the initializing period, the entire initialization is done or the selective initialization is done. To be more specific, all the discharge cells are initialized for discharging, or only the discharge cells that carried out the sustain discharge at the immediate last sub-field are initialized for discharging. This initialization initializes a charged state of discharge cells. The driving waveform shown in FIG. 4 initializes the entire cells during the initializing period of the first sub-field, and selectively initializes the cells during the initializing periods of the 2nd SF-10th SF.

First, during the initializing period of the first SF, all the discharge cells are initialized for discharging in order to erase the historical record of wall charges of the respective discharge cells as well as prepare wall charges necessary for the coming address operation. On top of that, this initialization also generates priming in order to minimize a discharge delay and generate steadily an address discharge. This entire initialization is done in this way: Keep all the data electrodes D1-Dm and all the sustain electrodes SUS1-SUSn at 0 (zero) volt (grounding potential), then apply a lamp voltage to all the scan electrodes SCN1-SCNn. The lamp voltage moderately increases from voltage Vp lower than the discharge starting voltage to voltage Vr over the discharge starting voltage.

The foregoing preparation allows all the discharge cells to discharge faintly, and allows the sustain electrodes as well as the data electrodes to store positive wall charges thereon, and allows the scan electrode to store negative wall charges thereon. Then keep all the sustain electrodes at voltage Vh, and apply a lamp voltage to all the scan electrodes, this lamp voltage moderately decreases from voltage Vg to voltage Va, so that all the discharge cells faintly discharge for weakening the wall charges stored on the respective electrodes. The entire initialization discussed above allows the voltage in the discharge cells to become close to the discharge starting voltage.

During the addressing period of the first SF, apply scan pulses sequentially to scan electrode SCN1 on the first line—scan electrode SCNn on the "n"th line, and apply address pulses, corresponding to the video signals to be displayed, to given data electrode Dj, thereby generating address discharge between the scan electrodes and the data electrodes in display cells for selectively forming wall charges.

During the sustaining period following the addressing period, firstly, apply the first sustain pulse PS1 to all the scan electrodes SCN1-SCNn for generating sustain discharge. Next, apply second sustain pulse PS2 to all the sustain electrodes SUS1-SUSn for generating sustain discharge. Then apply third sustain pulse PS3 to all the scan electrodes SCN1-SCNn, and in a given time delayed from the rise of sustain pulse PS3, apply voltage Vh to all the sustain electrodes SUS1-SUSn. These preparations allow applying a pulse voltage, of which width is smaller than that of sustain pulse PS2, between scan electrode SCNi and sustain electrode SUSi for generating the last sustain discharge. As discussed above, apply a given number of sustain pulses (at voltage Vm) to scan electrodes SCN1-SCNn and sustain electrodes SUS1-SUSn, thereby generating sustain discharge in the discharge cells, in which wall charges have been formed by the address discharge, for emitting light. This light emission during the sustaining period has a brightness in response to the brightness weight, and allows displaying a video. During the first SF shown in FIG. 4, sustain pulses PS1, PS2, and PS3, namely three pulses in total, are applied to the scan electrodes and the sustain electrodes.

During the initializing period of the second SF, keep all the sustain electrodes SUS1-SUSn at voltage Vh, and all the data electrodes D1-Dm at 0 (zero) volt. Then apply a lamp voltage to all the scan electrodes SCN1-SCNn. This lamp voltage moderately lowers from voltage Vb to voltage Va. While the lamp voltage lowers, the discharge cells, which have carried out sustain discharge during the immediate last sustain period, i.e. the sustain period of the first SF, faintly discharge for weakening the wall charges formed on the respective electrodes. The voltage in the discharge cells thus becomes close to the discharge starting voltage. On the other hand, the discharge cells, which have not carried out the address discharge and the sustain discharge during the first SF, do not discharge even faintly during the initializing period of the second SF, so that the wall charges are kept as they are at the time when the initializing period of the first SF ends.

During the addressing period and the sustaining period of the second SF, apply a waveform similar to that of the first SF to the respective electrodes, thereby generating sustain discharge in the discharge cells corresponding to video signals. During the 3rd SF-10th SF, apply a driving waveform similar to that of the second SF to the respective electrodes, thereby displaying a video.

As shown in FIG. 4, scan pulse Pn lastly applied during the addressing period is the scan pulse applied to scan electrode SCNn. Sustain pulse PS1 firstly applied during the sustaining period, is the sustain pulse applied to scan electrodes SCN1-SCNn. The last pulse-interval of each sub-field is a time interval between scan pulse Pn and sustain pulse PS1. FIG. 4 shows that last pulse-interval TP1, TP2, TP3, . . . and TP10 correspond to the first SF, second SF, third SF, . . . , and 10th SF respectively. As such, the last pulse-interval of the "k"th SF is referred to as TPk.

In this first embodiment, last pulse-interval TP1 and TP2 of the first SF and second SF are set longer than last pulse-intervals TP3-TP10 of the third SF and onward. The first SF and second SF are determined, in advance, as the sub-fields of a lower part of grayscale and a smaller brightness weight. Last pulse-intervals TP3-TP10 are set 15 μsec. which is similar to the last pulse-interval employed in the conventional driving method. Last pulse-intervals TP1 and TP2 are set longer than TP3-TP10, for instance, 35 μsec.

The foregoing setting allows the predetermined sub-fields of a lower part of grayscale to have the last pulse-interval longer than a conventional one, so that the priming effect in all the discharge cells due to the sustain pulse applied firstly during the sustaining period can be weakened comparing with the conventional one. In all the discharge cells, the sustain discharge due to the sustain pulse applied firstly during the sustaining period can be thus carried out at the same voltage and with the same timing. As a result, the problem of the conventional method, i.e. light-emission intensity by the sustain discharge due to the sustain pulse firstly applied becomes weak in discharge cells, can be overcome. As discussed above, a last pulse-interval of a sub-field having a lower part of grayscale is set longer than that of the other sub-fields, thereby suppressing the dark belt occurring in displaying a video of a lower part of grayscale. As a result, quality display of videos is obtainable.

Figure 5:
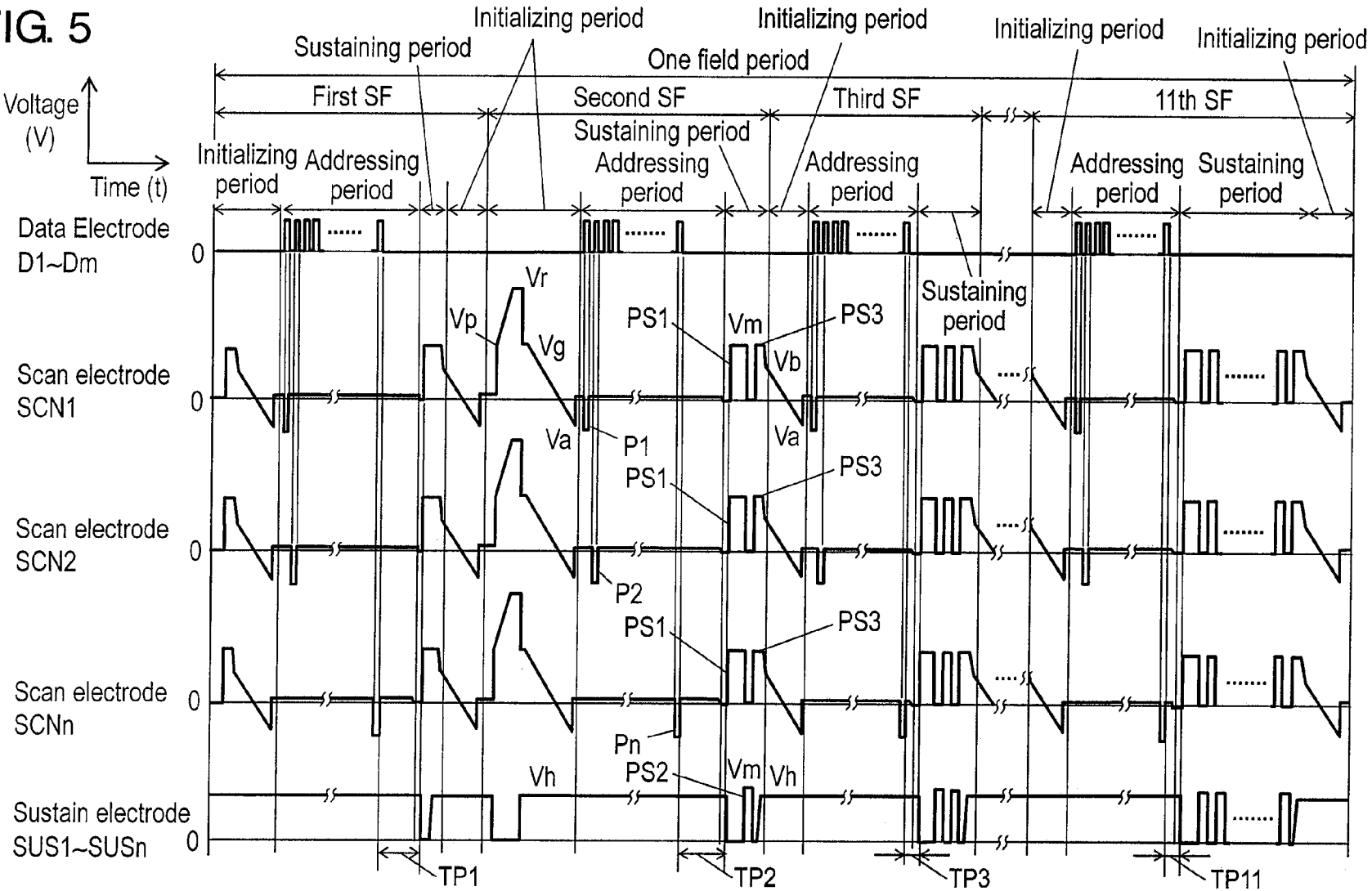
FIG. 5 shows a driving waveform for illustrating another driving method of the plasma display panel in accordance with the first embodiment.

FIG. 5 shows a driving waveform for illustrating another method of driving the plasma display panel in accordance with the first embodiment. One field shown in FIG. 5 has 11 sub-fields, namely, it has additional one sub-filed, which has a smaller brightness weight than that of the first SF shown in FIG. 4, besides the 10 sub-fields of the driving waveform shown in FIG. 4. In other words, the 2nd SF-11th SF shown in FIG. 5 have the same brightness weights respectively as the 1st SF-10th SF shown in FIG. 4, while the first SF in FIG. 5 is the additional sub-field.

In FIG. 5, the respective sub-fields, i.e. the 1st SF-the 11th SF, have a brightness weight of 0.5, 1, 2, 3, 6, 11, 18, 30, 44, 60, and 80. Each one of the sub-fields includes an initializing period, an addressing period, and a sustaining period. An operation during the respective periods remain unchanged from what is shown in FIG. 4. The 2nd SF-11th SF shown in FIG. 5 include the same waveforms as the 1st SF-10th SF shown in FIG. 4.

As shown in FIG. 5, during the sustaining period of the first SF, a voltage is applied to the scan electrodes, then to the sustain electrodes with some delay of timing, thereby applying one sustain pulse between the scan electrode and the sustain electrode. The presence of this additional first SF allows displaying a video of a lower part of grayscale more finely graded than that of the driving waveform shown in FIG. 4. In FIG. 5, last pulse-intervals TP1 and TP2 of the first SF and second SF are set longer than last pulse-intervals TP3-TP11 of the other sub-fields, i.e. the 3rd SF-11th SF. For instance, TP1=TP2=35 μsec, and each one of TP3-TP11=15 μsec. The foregoing structure allows suppressing the dark belt occurring in displaying a video of a lower part of grayscale, and obtaining quality display of videos.

In the foregoing instance, TP1 and TP2 take the same value; however, they can take different values as far as they are longer than TP3-TP10 in the case of FIG. 4 and TP3-TP11 in the case of FIG. 5. In the foregoing instance, two sub-fields of a lower part of grayscale are prepared in order to have the last pulse-interval greater than that of the other sub-fields; however, the present invention is not limited to the two sub-fields. The number of the sub-fields can be appropriately selected depending on a type of the panel and a limit of driving time.

For instance, one-three sub-fields can be selected from the sub-fields in the order of smaller brightness weights, and the last pulse-intervals of the selected sub-fields can be set longer than those of the other sub-fields. In other words, the last pulse-interval of at least one sub-field of a lower part of grayscale is set longer than those of the other sub-fields. The lower part of grayscale of this at least one sub-field is darker than a predetermined level of grayscale.

Figure 8:
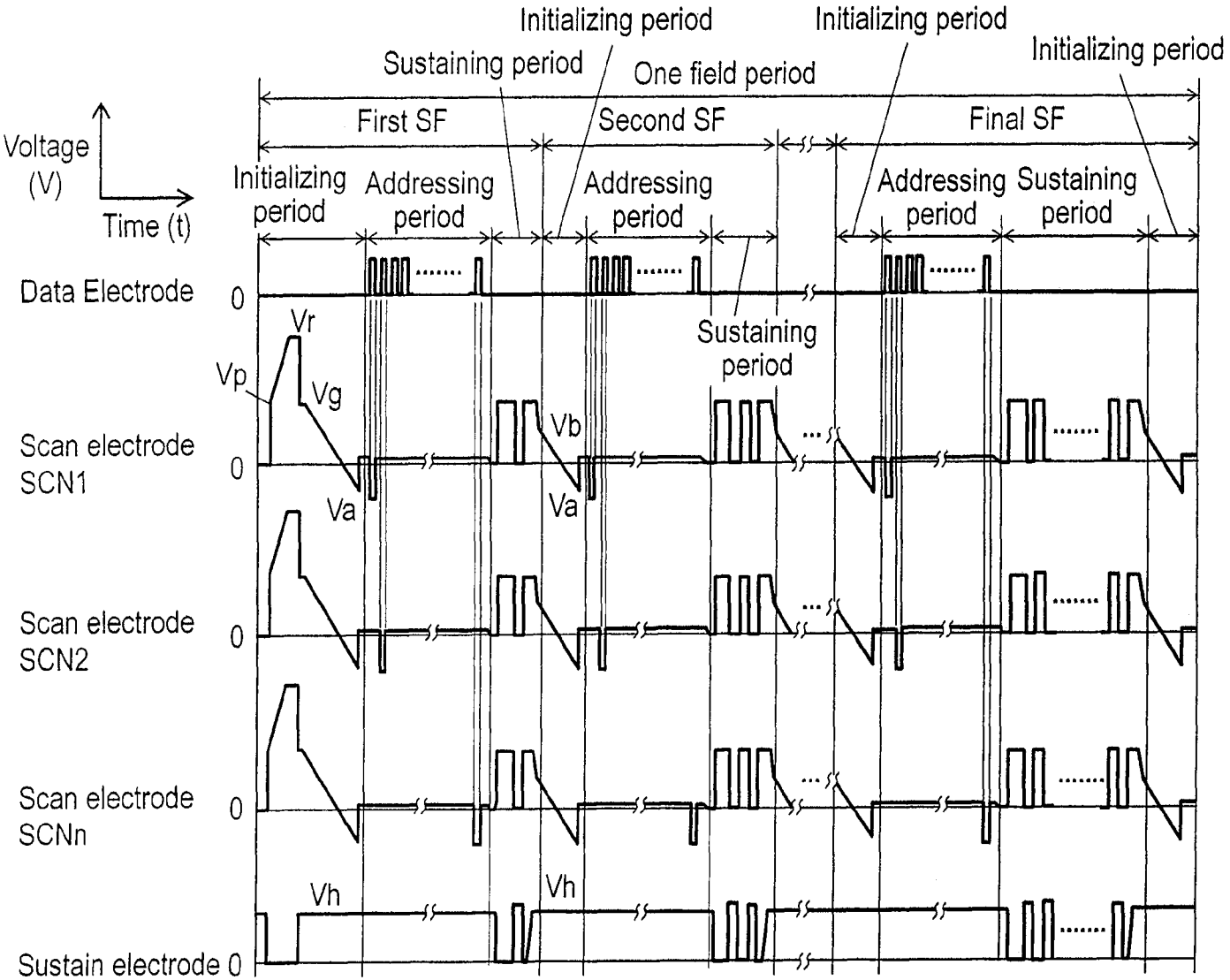
PRIOR ART FIG. 8
FIG. 8 shows a driving waveform for illustrating a conventional driving method of a plasma display panel.
Figure 9:
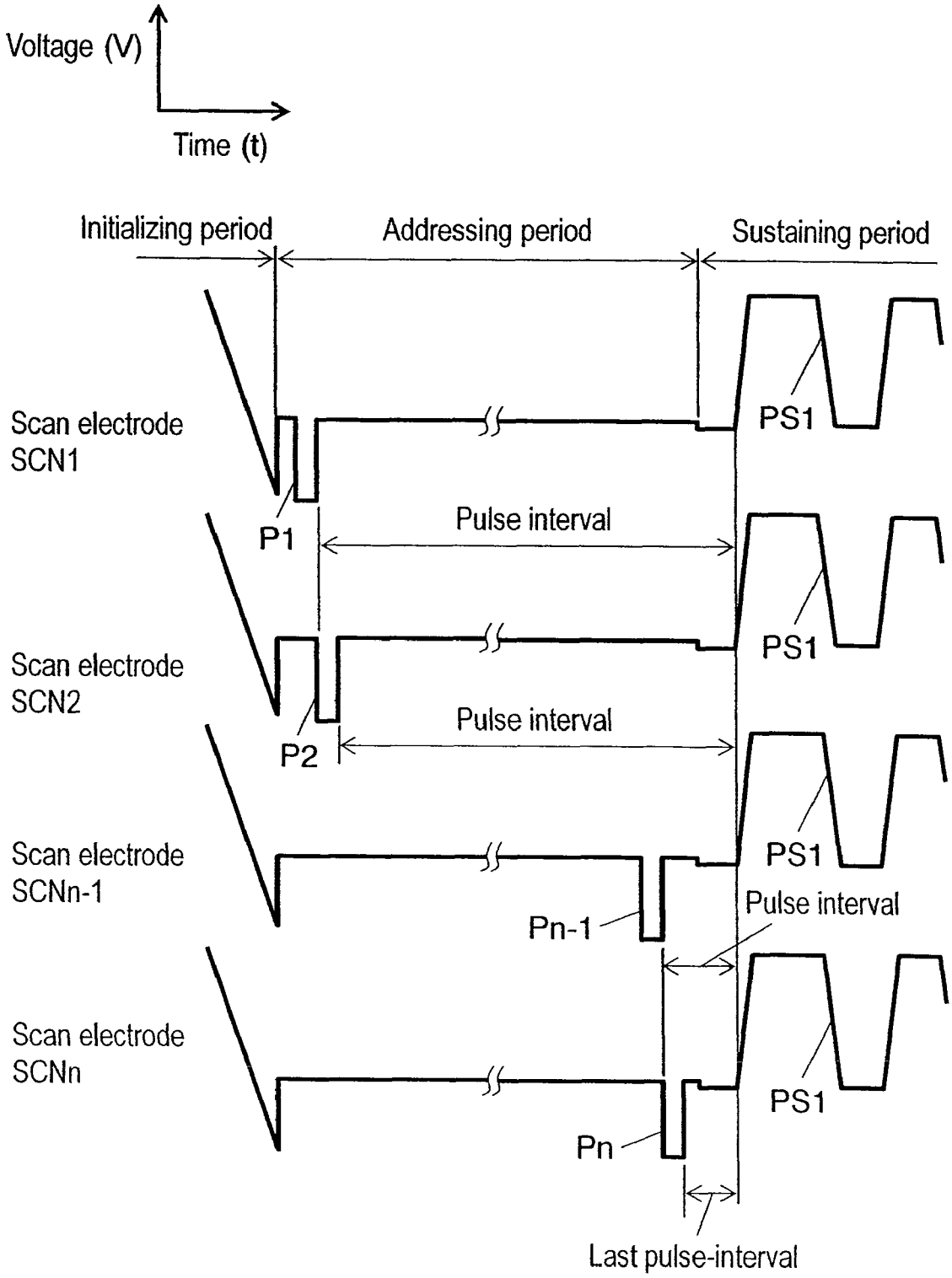
FIG. 9 PRIOR ART
FIG. 9 shows the driving waveform in part for illustrating the conventional driving method of the plasma display panel.

FIG. 6 shows the visibility of the dark belt in two rows. The upper row shows the visibility as the embodiment when the method of this first embodiment is used for driving a plasma display panel, and the lower row shows the visibility as a comparison purpose when the conventional driving method shown in FIG. 8. Those data are obtained by using the double-scanning driving method, and all the discharge cells generate sustain discharge in one or plural predetermined sub-fields for displaying a video.

The number of sustain pulses shown in FIG. 6 indicates the total number of sustain pulses applied to both of the scan electrodes and the sustain electrodes in all the sub-fields that generate sustain discharge. For instance, the driving waveform shown in FIG. 4 drives the panel such that sustain discharge is generated in the first SF and the third SF, and no sustain discharge is generated in the second SF, or in each one of 4th SF-10th SF, then the total number of sustain pulses applied to both of the scan electrodes and the sustain electrodes becomes 10, namely, 3 pulses in the first SF and 7 pulses in the third SF. In FIG. 6, "A" indicates that the dark belt is not recognized and quality display is obtained, while "B" indicates that the dark belt is faintly recognized, and "C" indicates that the dark belt is positively recognized.

As shown in FIG. 6, in the case of "comparison", the dark belt cannot be seen when the number of sustain pulses is 40 or 50, and quality display is obtained. The reason is this: When a video of a higher part of grayscale is displayed with a large number of sustain pulses, if the light emission of the sustain discharge by the first sustain pulse applied during the sustaining period becomes dark, this one light-emission affects the display of grayscale only a little, so that the human eyes cannot recognize the affected grayscale. However, the dark belt becomes recognizable when the number of sustain pulses is not greater than 30, and the display quality lowers. Some measures should be thus taken for the dark belt not to be recognized when the number of sustain pulses is at least not greater than 30.

On the other hand, in the case of "embodiment" shown in FIG. 6 tells that no dark belt can be seen when the number of sustain pulses is not greater than 30, so that quality display is obtained. When the number of sustain pulses is 40 or 50, no dark belt can be seen as the dark belt is not recognizable in the case of "comparison" of FIG. 6, and the quality display is obtained.

The driving method of the present invention thus proves the following fact: a certain sub-field, whose last pulse-interval of a lower part of grayscale is longer than those of the other sub-fields, is selected in such a manner that the total number of sustain pulses of the certain sub-field to be applied to both of the scan electrodes and the sustain electrodes during this sub-field is selected from the range of 1-30 (including both the ends), so that the dark belt can be suppressed appropriately when a video of a lower part of grayscale is displayed.

In this first embodiment, sub-fields are arranged following the order of smaller brightness weights; however, the present invention is not limited by this order, and the sub-fields can be arranged following another order than the smaller brightness weights.

Embodiment 2

Figure 7:
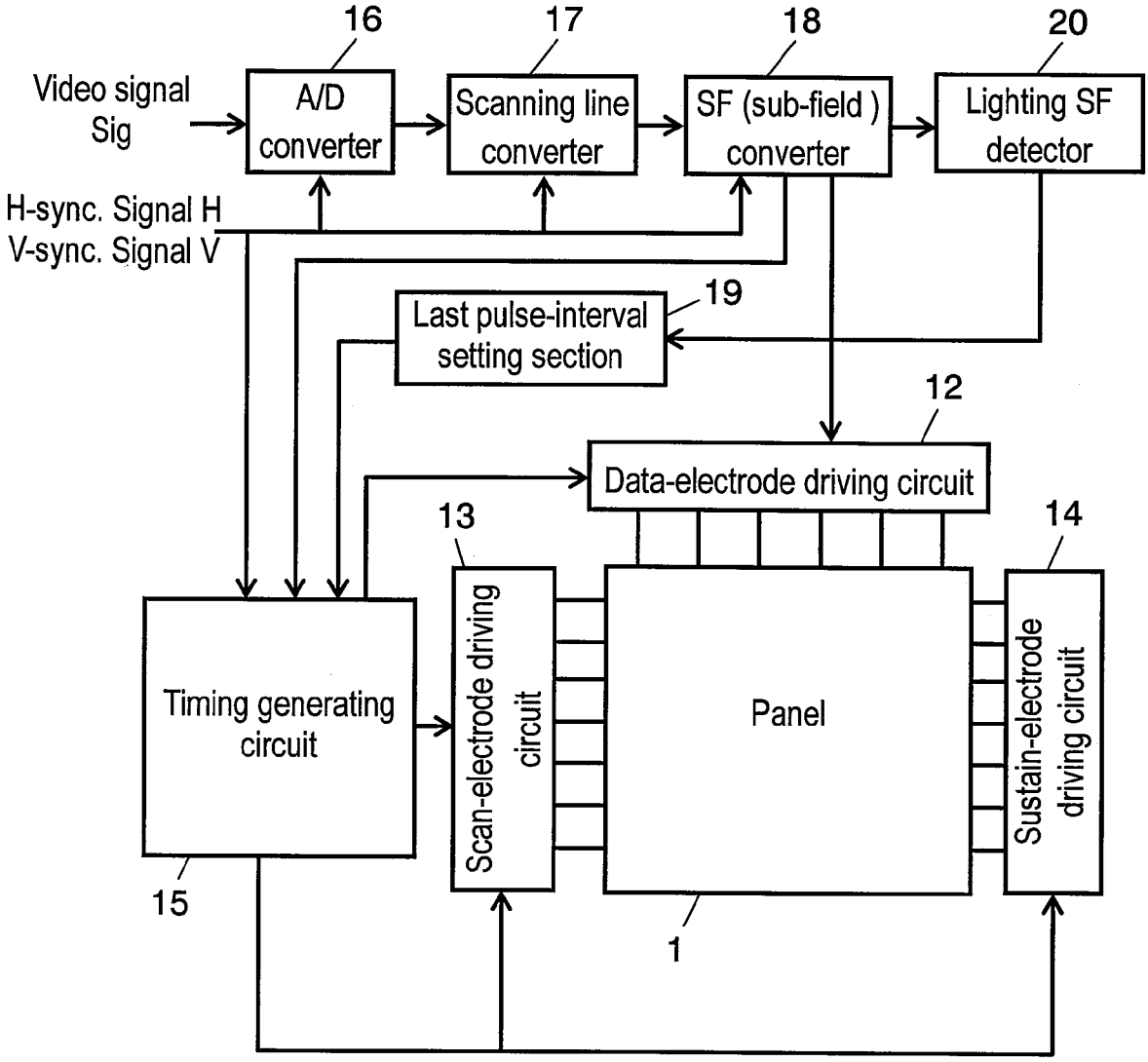
FIG. 7 shows a structure of a plasma display device for illustrating a driving method of a plasma display panel in accordance with a second embodiment.

FIG. 7 shows a structure of a plasma display device for illustrating a method of driving a plasma display panel in accordance with the second embodiment. The device includes lighting SF detector 20 additionally besides the elements shown in the first embodiment, namely, panel 1, data-electrode driving circuit 12, scan-electrode driving circuit 13, sustain-electrode driving circuit 14, timing generating circuit 15, A/D converter 16, scanning line converter 17, SF converter 18, and last pulse-interval setting section 19. Lighting SF detector 20 detects a lighting sub-field.

In this second embodiment, lighting SF detector 20 detects a lighting sub-field, and when a sub-field of a lower part of grayscale darker than a predetermined level of grayscale is lighted, the last pulse-interval of this sub-field is set longer than those of the other sub-fields. When the sub-field of a lower part of grayscale is not lighted, the last pulse-interval of this sub-field is set equal to those of the other sub-fields, for instance, the value of the last pulse-interval used in the first embodiment. The lighting sub-filed indicates that at least one discharge cell generates sustain discharge in this sub-field, and "a sub-field not lighted" indicates that no discharge cell generates sustain discharge in this sub-field.

When a sub-field of a lower part of grayscale is not lighted, setting of a longer last pulse-interval cannot produce the advantage of the present invention, so that a driving time becomes useless. Driving a higher definition panel or displaying a video of higher brightness requires the driving time as much as possible. In such a case, as described in this second embodiment, only when a sub-field of a lower part of grayscale is lighted, the last pulse-interval of this sub-field can be set longer than those of the other sub-fields. This preparation allows suppressing the dark belt occurring when a video of a lower part of grayscale is displayed, so that quality display is obtainable and useless driving time can be eliminated.

In the case where a last pulse-interval of a certain sub-field of a lower part of grayscale is set longer than those of the other sub-fields, similar to the first embodiment, in this second embodiment it is preferable that the total number of sustain pulses to be applied to both of the scan electrodes and the sustain electrodes during this sub-field is selected from the range of 1-30 (including both the ends).

INDUSTRIAL APPLICABILITY

The present invention provides a driving method of plasma display panels, and the method can suppressing a dark belt occurring in displaying a video of a lower part of grayscale, so that quality display is obtainable. The method is thus useful to drive the plasma display panels used in slim and lightweight display devices having large screens.

The invention claimed is:

1. A method of driving a plasma display panel which comprises:

a substrate on which a plurality of pairs, each one of which pairs is formed of a scan electrode and a sustain electrode, are placed; and another substrate, on which a plurality of data electrodes are so arranged to intersect with the scan electrodes and the sustain electrode at right angles, confronting the substrate, the method comprising the steps of:

dividing one field into a plurality of sub-fields, each one of the sub-fields has an addressing period during which a scan pulse is applied to the scan electrodes and a data pulse is applied to the data electrodes, and a sustaining period during which a sustain pulse is applied to both of the scan electrodes and the sustain electrodes;

defining a time interval between a scan pulse applied lastly during the addressing period and a sustain pulse applied firstly during the sustaining period as a last pulse-interval; and setting the last pulse-interval of at least one sub-field of a lower part of grayscale, which lower part is darker than a predetermined level of the grayscale, longer than the last pulse-intervals of other sub-fields.

2. The driving method of claim 1, wherein when the sub-field of the lower part of grayscale is lighted, the last pulse-interval of the sub-field is set longer than the last pulse-intervals of sub-fields other than the sub-field.

3. The driving method of claim 1, wherein a total number of the sustain pulses to be applied to the scan electrodes and the sustain electrodes in the sub-field of a lower part of grayscale is set one or more than one but not greater than 30.

4. The driving method of claim 2, wherein a total number of the sustain pulses to be applied to the scan electrodes and the sustain electrodes in the sub-field of a lower part of grayscale is set one or more than one but not greater than 30.

* * * * *